US006233397B1

(12) United States Patent
Offir

(10) Patent No.: US 6,233,397 B1
(45) Date of Patent: May 15, 2001

(54) DUAL POWER RATED ELECTRIC HEATER

(75) Inventor: Yigal Offir, Milford, MA (US)

(73) Assignee: The Holmes Group, Inc., Sparks, NV (US)

( * ) Notice: Subject to any disclaimer, the term of this patent is extended or adjusted under 35 U.S.C. 154(b) by 0 days.

(21) Appl. No.: 09/022,799

(22) Filed: Feb. 13, 1998

Related U.S. Application Data

(60) Provisional application No. 60/038,398, filed on Feb. 14, 1997.

(51) Int. Cl.[7] ..... F24H 3/00; B23K 13/08

(52) U.S. Cl. ..... 392/373; 219/477

(58) Field of Search ..... 219/477, 508–510, 219/240, 241, 251, 257, 452, 453, 414, 514, 519; 392/360, 365–369, 373, 374

(56) References Cited

U.S. PATENT DOCUMENTS

| | | | | |
|---|---|---|---|---|
| 1,534,542 | * | 4/1925 | Reimers et al. | 219/251 |
| 2,285,776 | * | 6/1942 | Maccoy | 219/510 |
| 2,507,736 | * | 5/1950 | Ritchie et al. | 219/240 |
| 2,773,166 | * | 12/1956 | Best | 219/510 |
| 2,926,233 | | 2/1960 | Holtkamp . | |
| 2,944,135 | | 7/1960 | Holtkamp . | |
| 4,217,482 | * | 8/1980 | Wadia | 219/494 |
| 4,366,366 | * | 12/1982 | Ekblad | 219/492 |
| 4,841,127 | * | 6/1989 | Prager et al. | 219/225 |
| 4,968,870 | | 11/1990 | Moon | 219/222 |
| 5,270,520 | | 12/1993 | Barzilai et al. | 219/501 |

FOREIGN PATENT DOCUMENTS

| | | | | |
|---|---|---|---|---|
| 256460 | * | 3/1949 | (CH) | 219/510 |
| 3146383 | * | 5/1983 | (DE) . | |
| 3151154 | * | 7/1983 | (DE) . | |
| 297 06 334 U | * | 7/1997 | (DE) . | |
| 2669803 | * | 5/1992 | (FR) . | |
| 346825 | * | 4/1931 | (GB) | 219/508 |
| 420392 | * | 11/1934 | (GB) | 219/508 |
| 2069778 | * | 8/1981 | (GB) . | |
| 3-20988 | * | 1/1991 | (JP) . | |
| 3-165714 | * | 7/1991 | (JP) . | |
| 3-297086 | * | 12/1991 | (JP) . | |
| 219614 | * | 7/1967 | (SE) | 219/519 |

* cited by examiner

*Primary Examiner*—Teresa Walberg
*Assistant Examiner*—Daniel Robinson
(74) *Attorney, Agent, or Firm*—Hoffmann & Baron, LLP; Francis E. Marino

(57) ABSTRACT

A portable heater operates at a first power rating to rapidly heat a space and a second power rating, lower than the first, to safely maintain the temperature of the space. The heater uses a first resistive heating element and a second resistive heating element which are configured to automatically supply the first power rating during an initial heating period then step down to the second power rating for continuous operation.

5 Claims, 3 Drawing Sheets

DUAL POWER RATED ELECTRIC HEATER

This application claims the benefit of United States Provisional Patent Application Serial Number 60/038,398, filed on Feb. 14, 1997.

FIELD OF THE INVENTION

The present invention relates to electric heaters, and more particularly relates to an heater with automatic switching of series and parallel heating element connections capable of operating at a first power rating and a second power rating.

BACKGROUND AND DESCRIPTION OF THE PRIOR ART

Portable electric heaters must presently be limited to an electrical capacity of 1500 watts. This limit for continuous operation is set to reduce the risk of fire associated with continuous use heating devices operating at capacities beyond this power rating. This limit is also enforced by product certification laboratories such as Underwriters Laboratories.

However, in an enclosed space to be heated, the operation of a heater at 1500 watts or less results in extended heating times. Therefore, there is a need for an electric heater which operates at a higher power rating during the initial heating cycle when the space is at its coldest and then operates at a lower power rating for the remaining continuous heating operation.

OBJECTS AND SUMMARY OF THE INVENTION

It is an object of the present invention to provide an electric heater which will rapidly heat a given space without increasing the risk of fire.

It is another object of the present invention to provide a two-stage electric heater which operates at an initial high power level at the beginning of a heater cycle, then automatically drops to a lower power level for continuous operation.

In accordance with one form of the present invention, a heater is formed having two resistive heater elements and an automatic switching device. The switching device initially selects the heater elements to provide a first, reduced resistance for the initial a predetermined operating time of the heater, then selects a higher resistance for the remaining continuous operation of the heater.

In accordance with another form of the present invention, a heater is formed with a first resistive heating element and a second resistive heating element connected to form a series circuit. The heater further includes a thermally responsive switch coupled across the second resistive heating element. The thermally responsive switch initially presents a short circuit across the second resistive heating element, thereby reducing the total resistance of the series circuit. Upon detection of a predetermined temperature, the thermally responsive switch opens, thereby increasing the resistance of the series circuit. In the presence of a substantially constant voltage applied to the series circuit, the operation of the switch results in a first operating power and a second, lower operating power. In accordance with a preferred embodiment of the present invention, the thermally responsive switch latches after the predetermined temperature is reached and remains latched until the voltage is removed.

In accordance with another form of the present invention, a heater is formed with a first resistive heating element and a second resistive heating element connected to form a series circuit. The heater further includes an electrically controllable switch coupled across the second resistive heating element. The electrically controllable switch initially presents a short circuit across the second resistive heating element, thereby reducing the total resistance of the series circuit. Upon receipt of a control signal, the electrically controllable switch opens, thereby increasing the resistance of the series circuit. The heater includes a timer circuit which generates the control signal upon initial detection of a voltage applied to the series circuit. In the presence of a substantially constant voltage applied to the series circuit, the operation of the switch results in a first operating power for an initial time period and a second, lower operating power for the remaining time of operation.

In accordance with yet another form of the present invention, a heater is formed with a first resistive heating element and a second resistive heating element connected to form a parallel circuit. The heater further includes a thermally responsive switch coupled in series with the second resistive heating element. The thermally responsive switch initially presents a short circuit, thereby reducing the total resistance of the parallel circuit. Upon detection of a predetermined temperature, the thermally responsive switch opens, thereby increasing the resistance of the parallel circuit. In the presence of a substantially constant voltage applied to the parallel circuit, the operation of the switch results in a first operating power and a second, lower operating power. In accordance with a preferred embodiment of the present invention, the thermally responsive switch latches after the predetermined temperature is reached and remains latched until the voltage is removed.

In accordance with yet another form of the present invention, a heater is formed with a first resistive heating element and a second resistive heating element connected to form a parallel circuit. The heater further includes an electrically controllable switch coupled in series with the second resistive heating element. The electrically controllable switch initially presents a short circuit, thereby reducing the total resistance of the parallel circuit. Upon receipt of a control signal, the electrically controllable switch opens, thereby increasing the resistance of the parallel circuit. The heater includes a timer circuit which generates the control signal upon initial detection of a voltage applied to the parallel circuit. In the presence of a substantially constant voltage applied to the parallel circuit, the operation of the switch results in a first operating power for an initial time period and a second, lower operating power for the remaining time of operation.

DETAILED DESCRIPTION OF THE INVENTION

When an enclosed space is to be heated, it is desirable to operate a portable space heater at the highest allowable power rating during a predetermined initial time period of the heating cycle, i.e., when the space is at its coldest temperature. To reduce the risk of fire associated with high power operation, it is also desirable to throttle back the power rating of the heater after the initial a predetermined period, to a second, reduced power rating.

Figure 1:
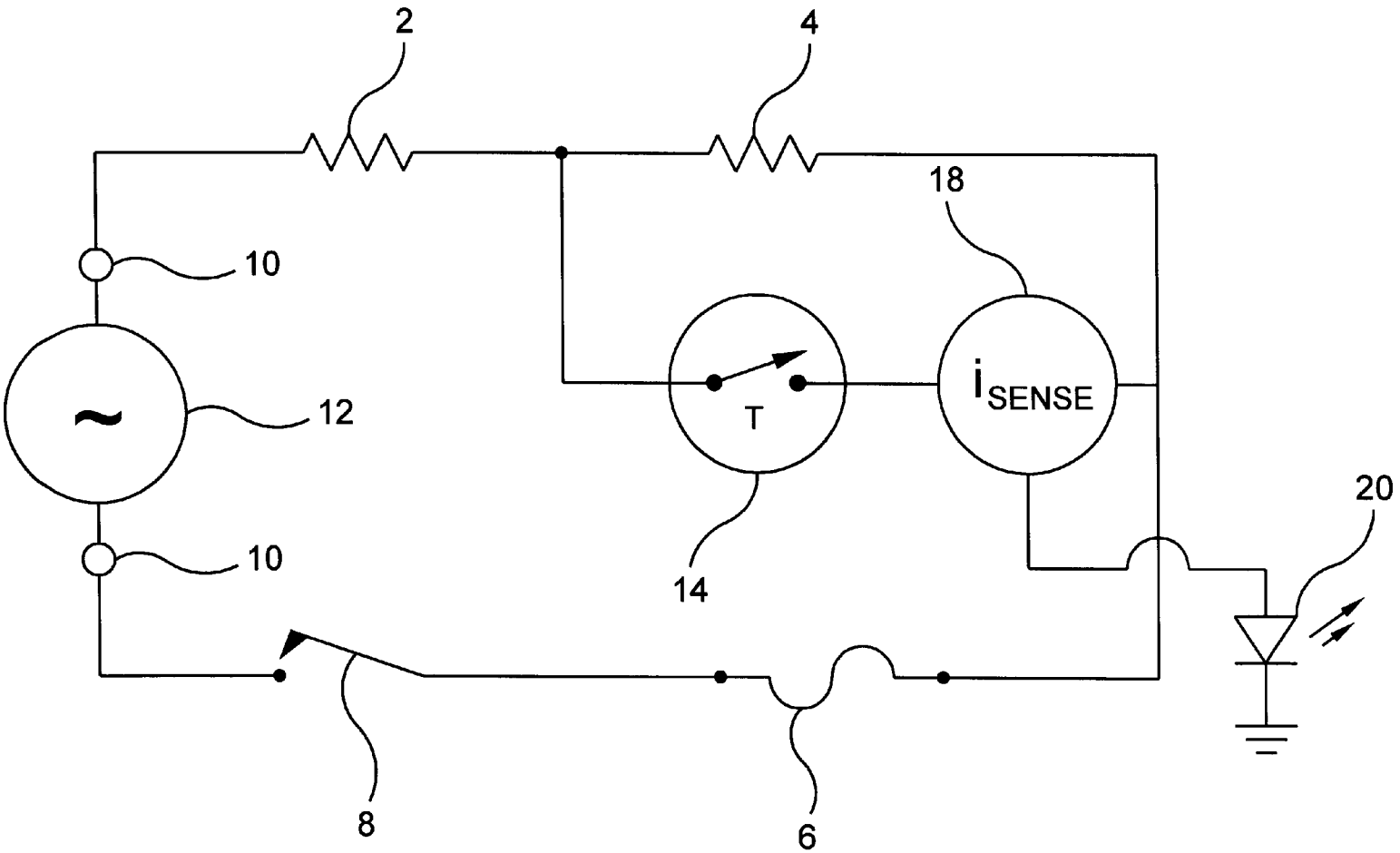
FIG. 1 is a schematic diagram of a heater circuit formed in accordance with the present invention.

FIG. 1 is a schematic diagram of a first embodiment of the present invention. The heater of FIG. 1 includes a series circuit formed by the connection of a first resistive heating element 2, a second resistive heating element 4, a thermal fuse 6 and a high-limit normally closed thermostat 8. Terminals 10 are included to attach the series circuit to an external power source 12.

The heater circuit of FIG. 1 further includes a thermal switch 14 which is connected in parallel with the second resistive heating element 4. Thermal switch 14 operates in a normally closed (low resistance) state when the device is at a first temperature, and an open state (high resistance) upon reaching a second, higher temperature. Preferably, thermal switch 14 is a positive temperature coefficient (PTC) device which latches in the open state until power is removed from the circuit.

When the power source 12 is first connected to the series circuit, the thermal switch 14 is in its initial, closed state. This places a short circuit across the second resistive heating element 4. Accordingly, the initial resistance of the series circuit is the resistance of the first resistive heating element 2. Upon reaching a predetermined temperature (associated with a predetermined time), the thermal switch 14 opens. This replaces the second resistive heating element 4 into the series circuit and increases the total circuit resistance. The increased total circuit resistance lowers the power rating of the heater for the remaining, continuous operation of the heater. As previously discussed, the use of a latching type device for the thermal switch 14 is preferred. This prevents the heater circuit from inadvertently reverting to the high power mode.

FIG. 1 further illustrates the use of an optional current sensor 18. The current sensor 18 is connected in series with the thermal switch 14. The current sensor 18 is a low resistance device that detects current flow and activates a display element 20 to indicate the mode of operation of the heater, i.e., high power, fast heating mode or constant power mode. Alternatively, a voltage sensor may be operatively coupled across the second resistive heating element 4 to perform the mode detection function.

Figure 2:
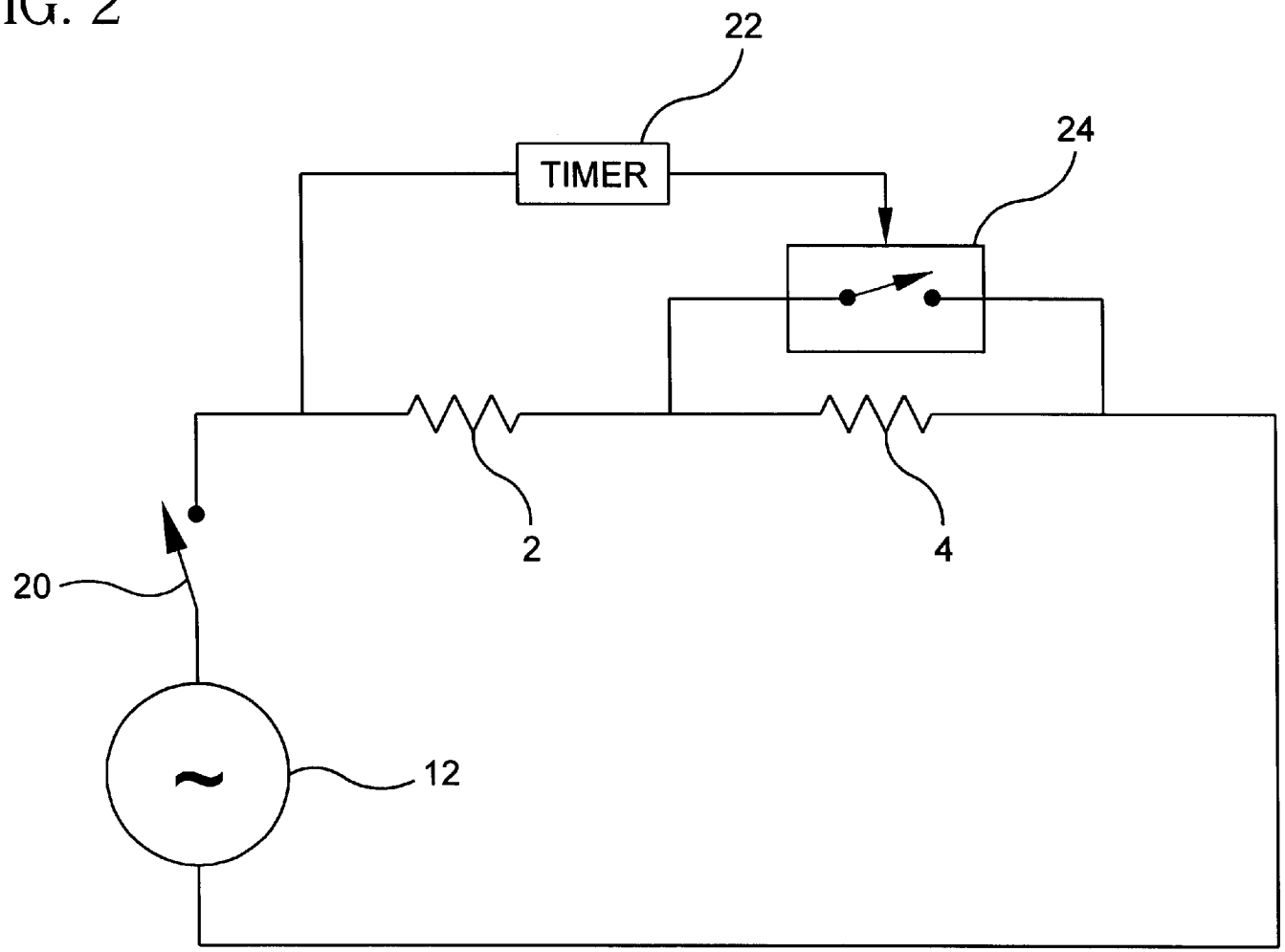
FIG. 2 is a schematic diagram of a heater circuit formed in accordance with the present invention.

FIG. 2 illustrates an alternate embodiment of a heater circuit formed in accordance with the present invention. Referring to FIG. 2, the heater circuit includes a first resistive heating element 2, a second resistive heating element 4, a power source 12 and a single pole, single throw (SPST) switch 20 connected as a single series circuit. The heater further includes an electrically controllable switch 24. The electrically controllable switch 24 includes first and second switch terminals which are electrically connected across the second heating element 4. The electrically controllable switch 24 also includes at least a third control terminal which receives a control signal. In response to the received control signal, the switch terminals open (high resistance) or close (low resistance). The electrically controllable switch may take the form of a solid state switch or conventional relay. In this circuit configuration, when the switch terminals are closed, the second heater element 4 is bypassed (shorted) in the series circuit. This reduces the total circuit resistance and increases the power rating of the heater. As with the thermal switch 14, it is preferable that once the electrically controllable switch 24 is opened, it remains latched in this state until the circuit is de-energized.

The heater circuit of FIG. 2 further includes a timer circuit 22. The timer circuit 22 includes an input terminal which is electrically connected to the series circuit and an output terminal which is electrically connected to the control terminal of the electrically controllable switch 24. The timer circuit 22 detects when the series circuit is energized (SPST switch 20 closed). This condition initializes the timer output terminal to a first state which closes switch 24. Accordingly, the heater is initially in a high output mode to quickly warm the environment when the most heat is needed. After a predetermined time, the timer circuit 22 changes the state of the output terminal, thereby opening switch 24. With switch 24 opened, the second resistive heating element 4 is replaced in the series circuit thereby reducing the power rating of the heater for the remaining heating period. Thus, the continuous duty cycle of the heater operates at the lower power rating. The timer circuit 22 may be realized by employing an appropriately configured 555 integrated circuit timer or other conventional timing circuit known in the art.

As an illustrative example, the heater circuit of FIGS. 1 and 2 may be constructed to provide 1800 watts of heat during the initial heating period and drop to 1500 watts of heat output for the balance of the heating period. This is achieved by selecting the first resistive heating element 2 to have a resistance of approximately 8 ohms (Ω), the second resistive heating element 4 to have a resistance of approximately 1.6 Ω and the power source to have a voltage potential of approximately 120 volts AC. Initially, when the second resistive heating element 4 is bypassed, the total resistance of the series circuit is 8 Ω. When the second resistive heating element is replaced in the circuit, the resistance increases to 9.6 Ω. As the voltage from power source 12 remains a constant 120 volts AC, this change in resistance effectively alters the power rating of the heater.

Figure 3:
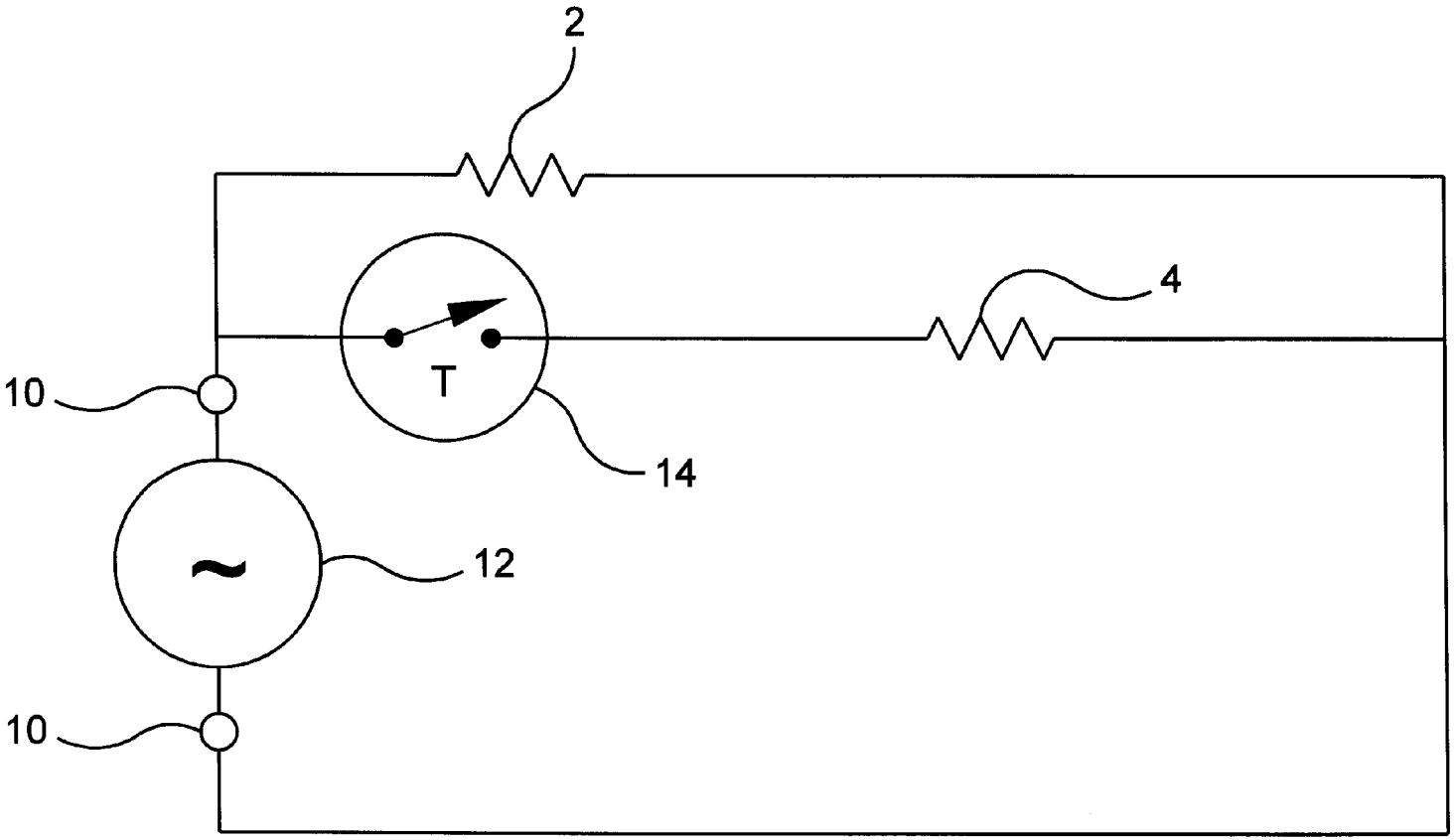
FIG. 3 is a schematic diagram of a heater circuit formed in accordance with the present invention.

FIG. 3 shows an embodiment of a two-stage heater circuit formed in accordance with the present invention using a parallel arrangement of the heating elements. In this embodiment, a first resistive heating element 2 is connected in parallel with a series combination of a thermal switch 14 and a second resistive heating element 4. An external power source 12 can be coupled across the parallel circuit by connection to terminals 10. As with the circuits of FIGS. 1 and 2, the heater of FIG. 3 operates at an initial high power rating for a first time period, then drops to a reduced power level for continuous operation. When the thermal switch 14 is closed, the resistance of the first and second heating elements combine in parallel to form a reduced combined resistance. When the thermal switch 14 is opened, the first resistive heating element is the only resistance in the circuit, thereby increasing the total circuit resistance and reducing the operating power. It will be appreciated that the thermal switch 14 may be replaced with other automatic control means, such as the timer circuit 22 and electrically controllable switch 24 illustrated in FIG. 2.

As an example of the operation of the circuit in FIG. 3, the heater circuit of the present invention may be constructed to provide an 1800 watt rating during the initial heating period and revert a 1500 watt rating for the balance of the heating period. This is achieved by selecting the first resistive heating element to have a resistance of 9.6 Ω, the resistance of the second resistive heating element to have a resistance of 48 Ω and the external power source to supply a voltage of 120 volts AC. When power is first applied to the circuit, the thermal switch 14 is closed and the total resistance of this circuit is the parallel combination of 48 Ω and 9.6 Ω. This total resistance is equal to 8 Ω. After a predetermined time, the thermal switch 14 opens and increases the resistance of the circuit to that of the first resistive heating element, or 9.6 Ω.

It will be appreciated by those skilled in the art, that the concept of a two-stage heating circuit as illustrated in FIGS. 1–3 can be extended to a multi-stage heater by adding additional heating elements and additional control elements. It will be further appreciated that the elements of the fuse 6, thermostat 8, current sensor 18 and display element 20 may also be implemented in the circuits of FIGS. 2 and 3.

Although illustrative embodiments of the present invention have been described herein with reference to the accompanying drawings, it is to be understood that the invention is not limited to those precise embodiments, and that various other changes and modifications may be effective therein by one skilled in the art without departing from the scope or spirit of the invention.

What is claimed is:

1. An electric space heater including an operating circuit comprising:

a first resistive heating element;

a second resistive heating element, said first and second resistive heating elements being connected to form a series circuit, said series circuit receiving a voltage from an external source; and a thermally responsive switch, said thermally responsive switch being operatively coupled across said second resistive heating element, said switch presenting a substantially short circuit below a predetermined ambient air temperature to operate the space heater at a first operating power and presenting a substantially open circuit above a sensed predetermined ambient air temperature to operate the space heater at a second operating power lower than the first operating power, and wherein said switch latches in the substantially open circuit condition upon detecting the predetermined ambient air temperature and remains latched to prevent operation of the space heater at said first operating power until the voltage to the heater operating circuit is terminated.

2. The electric heater as defined by claim 1, further comprising a display unity, said display unit being responsive to the thermally responsive switch and providing a visual indication of the operating power of the heater.

3. The electric heater as defined by claim 2, wherein said first operating power is about 1800 watts and said second operating power is about 1500 watts.

4. The electric heater as defined by claim 2, wherein:

said first resistive heating element has a resistance value of about 8 ohms;

said second resistive heating element has a resistance value of about 9.6 ohms;

and the voltage is about 120 volts.

5. An electric space heater including an operating circuit comprising:

a first resistive heating element;

a second resistive heating element, said first and second resistive heating elements being connected to form a parallel circuit, said parallel circuit receiving a voltage from an external source; and an automatic switch, said automatic switch configuring said first and second resistive heating elements to operate at a first operating power for a first predetermined period of time to rapidly heat ambient air in a space to be heated, and latchably configuring said first and second resistive heating elements to operate at a second operating power, lower than the first operating power, for further continuous heating of ambient air in a space to be heated after said first predetermined period of time wherein latching of the automatic switch prevents operation of the space heater at said first operating power until voltage to the heater operating circuit is terminated and the switch is permitted to reset.

* * * * *